US011728122B2

(12) United States Patent
Greenland

(10) Patent No.: US 11,728,122 B2
(45) Date of Patent: Aug. 15, 2023

(54) X-RAY TUBE BACKSCATTER SUPPRESSION

(71) Applicant: Moxtek, Inc., Orem, UT (US)

(72) Inventor: Kasey Otho Greenland, West Jordan, UT (US)

(73) Assignee: Moxtek, Inc., Orem, UT (US)

( * ) Notice: Subject to any disclaimer, the term of this patent is extended or adjusted under 35 U.S.C. 154(b) by 125 days.

(21) Appl. No.: 17/483,000

(22) Filed: Sep. 23, 2021

(65) Prior Publication Data

US 2022/0130632 A1 Apr. 28, 2022

Related U.S. Application Data

(60) Provisional application No. 63/104,699, filed on Oct. 23, 2020.

(51) Int. Cl.
*H01J 35/16* (2006.01)
*H01J 35/08* (2006.01)

(52) U.S. Cl.
CPC ..... *H01J 35/16* (2013.01); *H01J 35/112* (2019.05); *H01J 2235/168* (2013.01)

(58) Field of Classification Search
CPC ..... H01J 35/16; H01J 2235/168
See application file for complete search history.

(56) References Cited

U.S. PATENT DOCUMENTS

| | | | | |
|---|---|---|---|---|
| 2,836,748 | A * | 5/1958 | Atlee | H01J 35/16 378/139 |
| 6,288,840 | B1 | 9/2001 | Perkins et al. | |
| 6,665,119 | B1 | 12/2003 | Kurtz et al. | |
| 9,251,995 | B2 | 2/2016 | Ogura et al. | |
| 9,726,897 | B2 | 8/2017 | Huang et al. | |
| 10,139,536 | B2 | 11/2018 | Wang et al. | |
| 10,139,537 | B2 | 11/2018 | Nielson et al. | |
| 10,234,613 | B2 | 3/2019 | Wangensteen et al. | |

(Continued)

*Primary Examiner* — Chih-Cheng Kao
(74) *Attorney, Agent, or Firm* — Thorpe North & Western, LLP

(57) ABSTRACT

Electrons can rebound from an x-ray tube target, causing electrical-charge build-up on an inside of the x-ray tube. The charge build-up can increase voltage gradients inside of the x-ray tube, resulting in arcing failure of the x-ray tube. Also, the electrical charge can build unevenly on internal walls of the x-ray tube, causing an undesirable shift of the electron-beam. An x-ray tube (10 or 20) with multiple protrusions (19) on an interior wall of a drift-tube (18) can reduce this electrical-charge build-up. The protrusions (19) can reflect stray electrons back to the anode target (14), thus suppressing backscatter. Each protrusion (19) can have a peak ($\mathbf{19}_p$) extending into the hole ($\mathbf{18}_h$), and receding to a base ($\mathbf{19}_b$) farther from the electron-beam, on an entry-side ($\mathbf{19}_{en}$) nearest the drift-tube-entry ($\mathbf{18}_{en}$) and on an exit-side ($\mathbf{19}_{ex}$) nearest the drift-tube-exit ($\mathbf{18}_{ex}$).

20 Claims, 8 Drawing Sheets

(56) References Cited

U.S. PATENT DOCUMENTS

| | | | | |
|---|---|---|---|---|
| 10,453,643 | B2 | 10/2019 | Peterson et al. | |
| 2007/0297052 | A1 | 12/2007 | Wang et al. | |
| 2012/0075699 | A1 | 3/2012 | Davis et al. | |
| 2012/0307978 | A1* | 12/2012 | Yamazaki | H01J 35/06 378/121 |
| 2014/0300964 | A1 | 10/2014 | Davis et al. | |
| 2017/0068103 | A1 | 3/2017 | Huang et al. | |
| 2017/0287673 | A1* | 10/2017 | Peterson | H01J 35/186 |
| 2017/0293059 | A1 | 10/2017 | Nielson et al. | |
| 2018/0052257 | A1 | 2/2018 | Nielson et al. | |
| 2019/0041564 | A1 | 2/2019 | Nielson et al. | |
| 2021/0249213 | A1* | 8/2021 | He | H01J 35/14 |

* cited by examiner

X-RAY TUBE BACKSCATTER SUPPRESSION

CLAIM OF PRIORITY

This application claims priority to U.S. Provisional Patent Application No. 63/104,699, filed on Oct. 23, 2020, which is incorporated herein by reference.

FIELD OF THE INVENTION

The present application is related generally to x-ray sources.

BACKGROUND

An x-ray tube makes x-rays by sending electrons, in an electron-beam, across a voltage differential, to a target. X-rays form as the electrons hit the target.

But some electrons rebound, and fail to form x-rays. These electrons can cause an electrical charge to build-up on an inside of the x-ray tube. The charge build-up can be on sides of an electrically-insulative cylinder, such as a ceramic or glass cylinder. The charge build-up can cause sharp voltage gradients within the x-ray tube. These voltage gradients can cause arcing failure of the x-ray tube.

The electrical charge can build unevenly on the walls of the x-ray tube. This uneven charge can shift the electron-beam away from a center of the target. As a result of this shift, x-rays are emitted from different location(s) of the target. Aiming the moving, or non-centered, x-ray beam can be difficult.

BRIEF DESCRIPTION OF THE DRAWINGS (DRAWINGS MIGHT NOT BE DRAWN TO SCALE)

Figure 1:
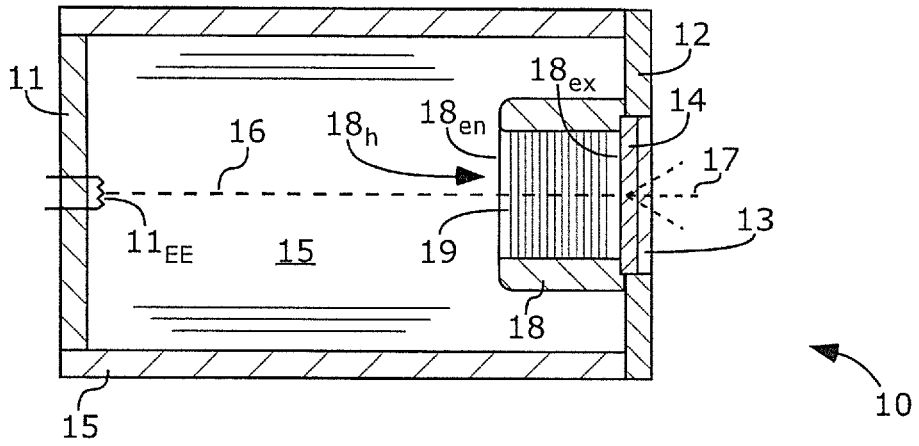

FIG. 1 is a cross-sectional side-view of a transmission-target x-ray tube 10 with (i) a drift-tube 18, (ii) a hole $\mathbf{18}_h$ through the drift-tube 18 aimed for electrons from the electron-emitter $\mathbf{11}_{EE}$ to pass through to the target 14, and (iii) multiple protrusions 19 on an internal wall of the hole $\mathbf{18}_h$.

Figure 2:
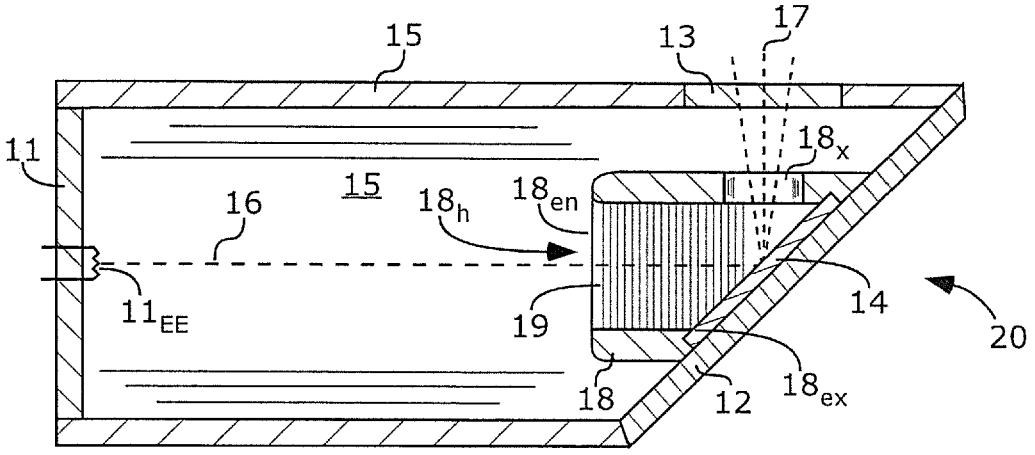

FIG. 2 is a cross-sectional side-view of a reflective-target and side-window x-ray tube 20 with a drift-tube 18 similar to the drift-tube 18 of FIG. 1.

Figure 3:
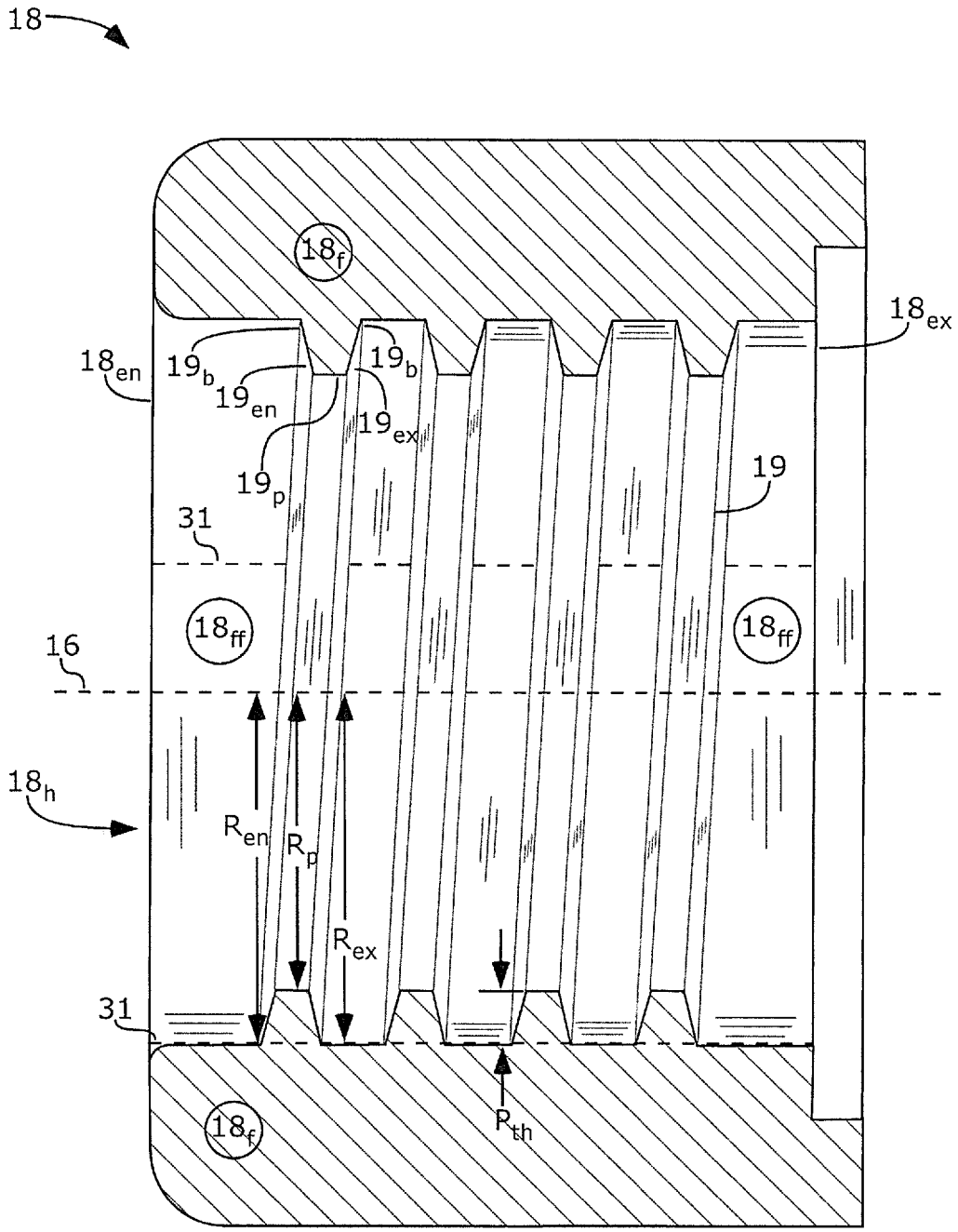

FIG. 3 is a cross-sectional side-view of a drift-tube 18, similar to the drift-tubes 18 of FIGS. 1-2, with internal-thread protrusions 19.

Figure 4:
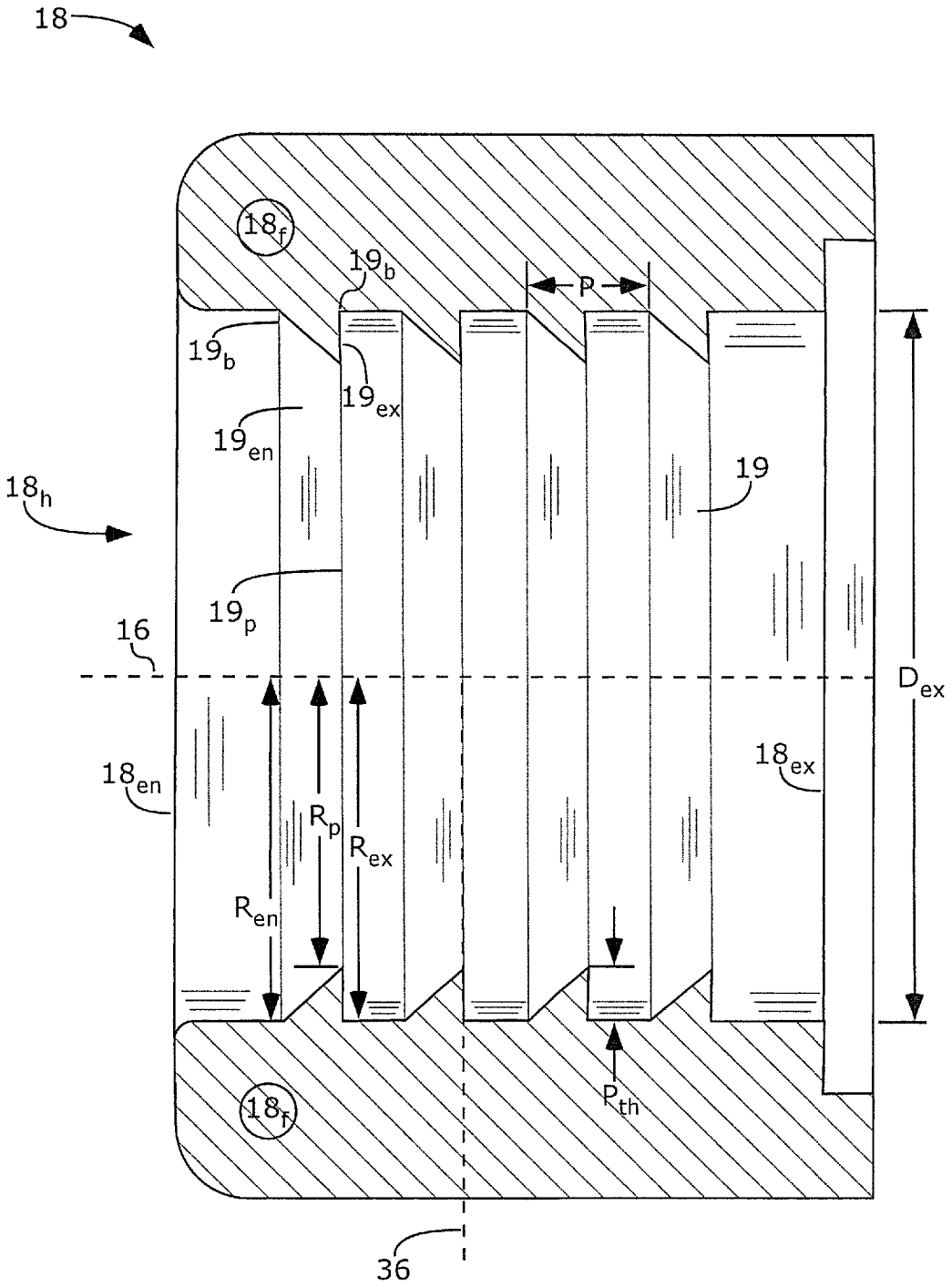

FIG. 4 is a cross-sectional side-view of a drift-tube 18, similar to the drift-tubes 18 of FIGS. 1-2, with protrusions 19 having an exit-side $\mathbf{19}_{ex}$ that is perpendicular to an axis 16 of the electron-beam.

Figure 5:
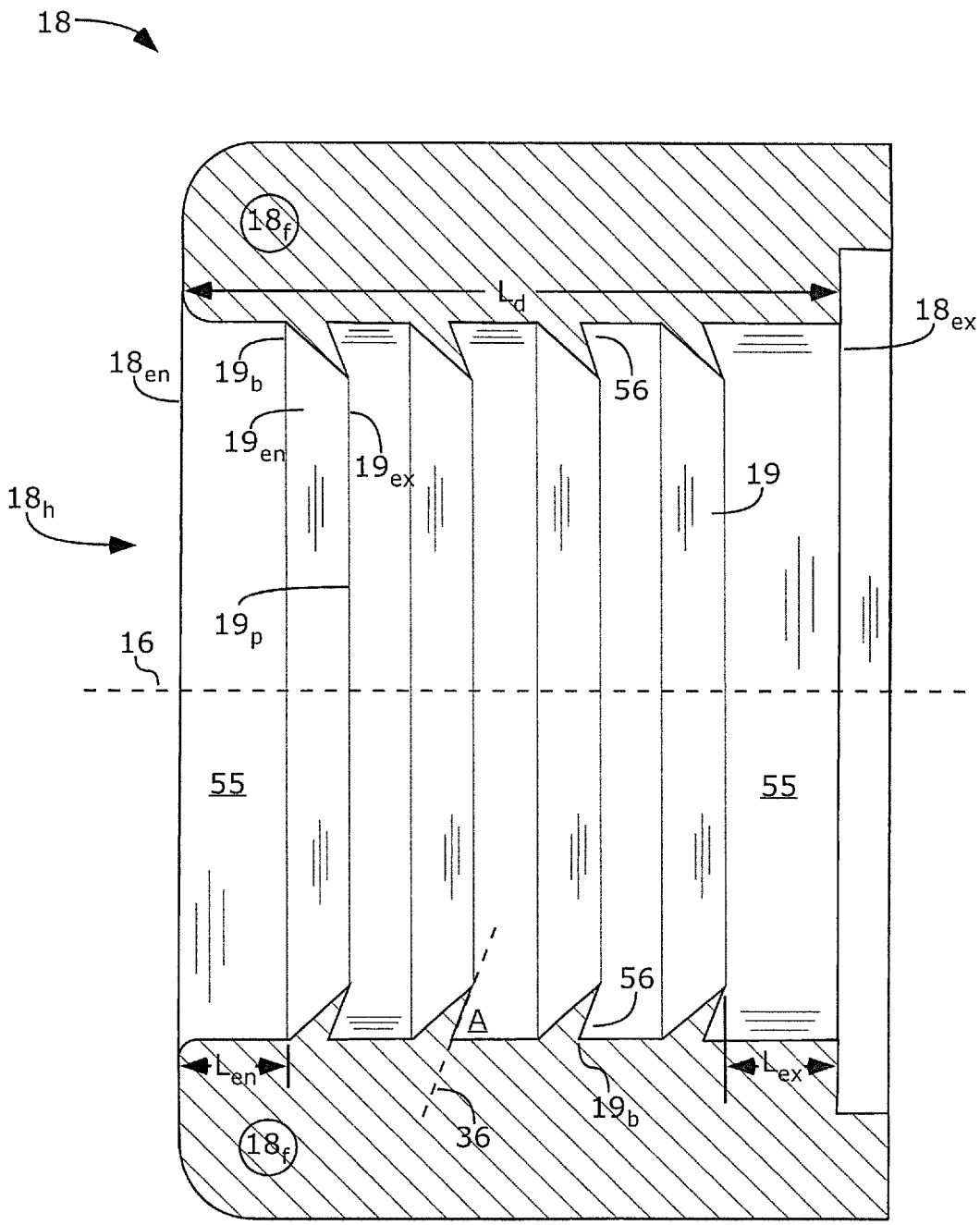

FIG. 5 is a cross-sectional side-view of a drift-tube 18, similar to the drift-tubes 18 of FIGS. 1-2, with an exit-side $\mathbf{19}_{ex}$ of the protrusions 19 forming an acute angle A with respect to a footing $\mathbf{18}_f$ of the drift-tube 18 to which the protrusion 19 is attached.

Figure 6A:
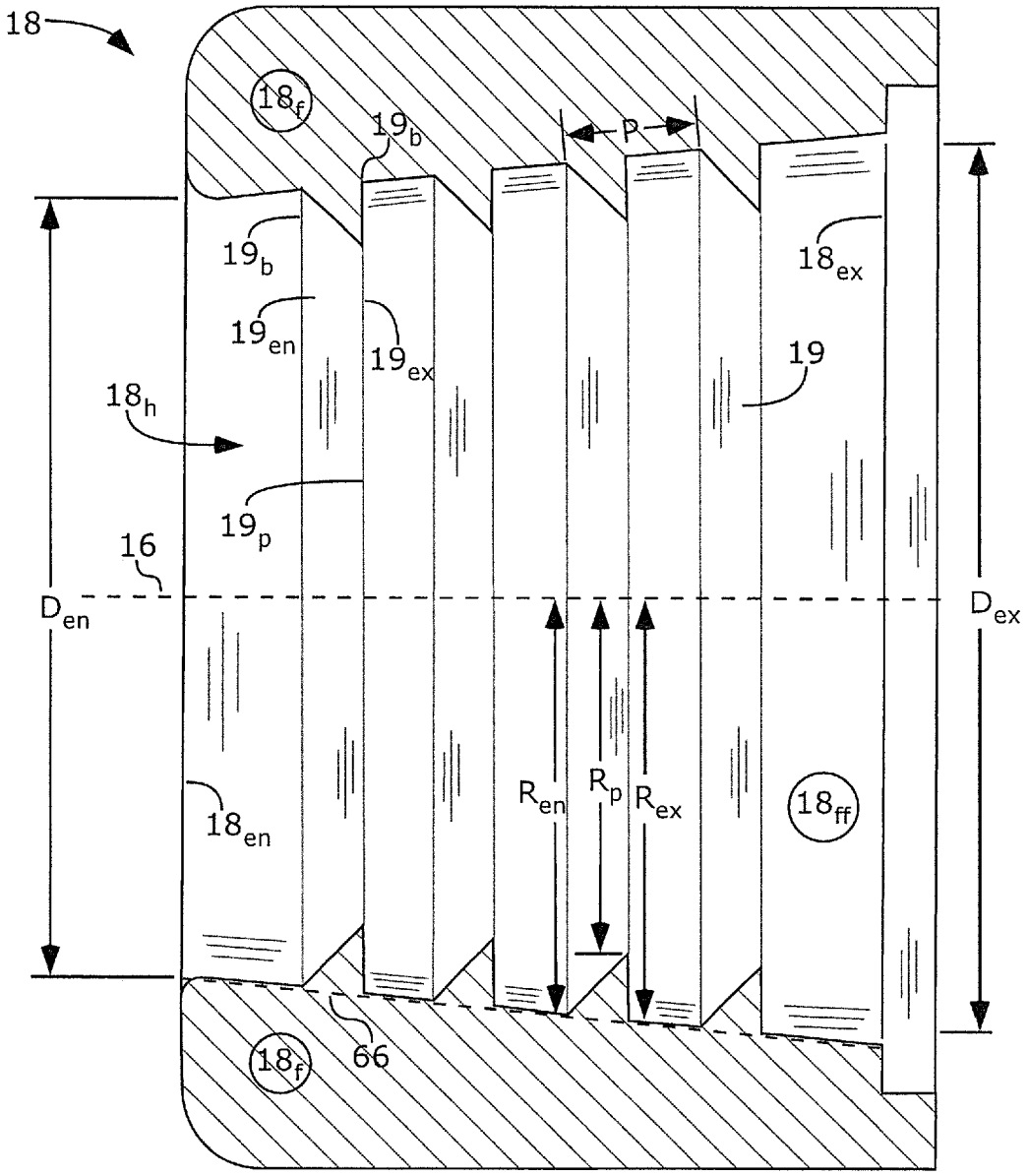

FIG. 6*a* is a cross-sectional side-view of a drift-tube 18, similar to the drift-tubes 18 of FIGS. 1-2, with walls of the hole $\mathbf{18}_h$ forming a tapered internal diameter.

Figure 6B:
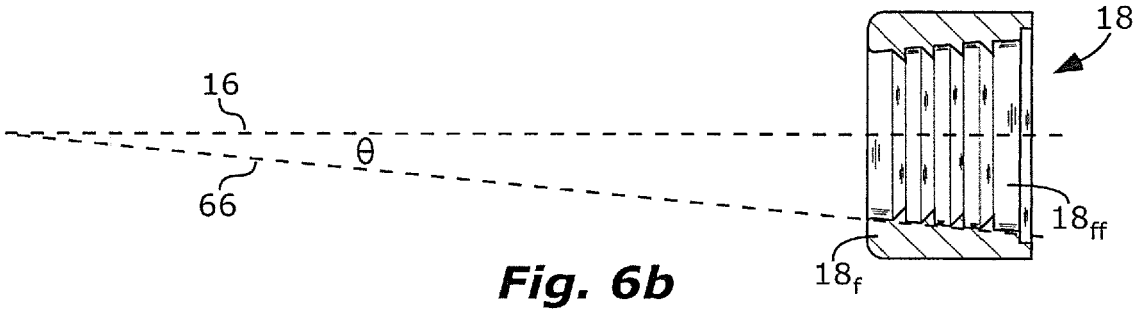

FIG. 6*b* is a cross-sectional side-view of the drift-tube 18 of FIG. 6*a*, illustrating an acute-angle θ between the axis 16 of the electron-beam and a line 66 along a face $\mathbf{18}_{ff}$ of a footing $\mathbf{18}_f$ of the drift-tube 18.

Figure 7:
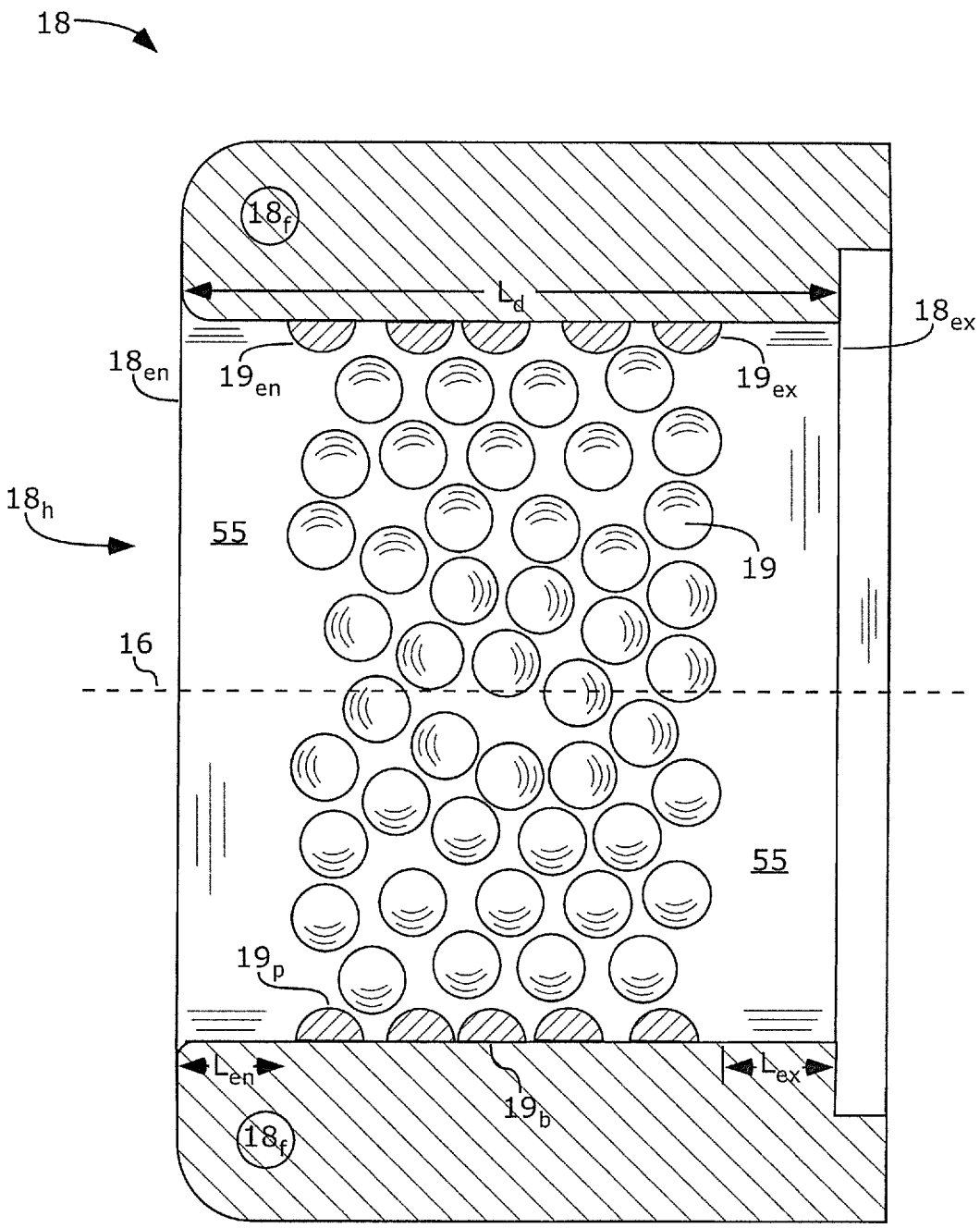

FIG. 7 is a cross-sectional side-view of a drift-tube 18, similar to the drift-tubes 18 of FIGS. 1-2, with bump protrusions 19.

Figure 8:
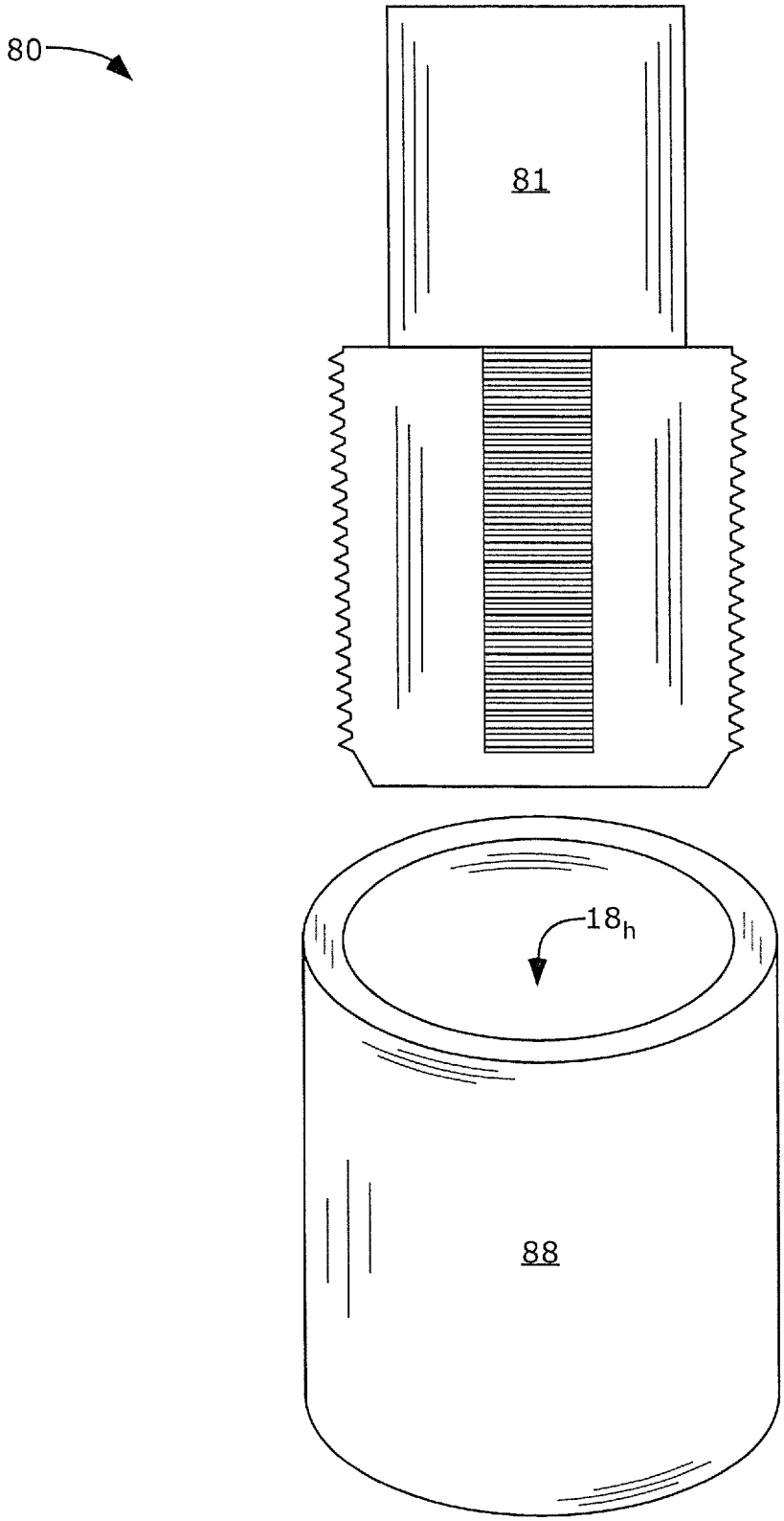

FIG. 8 is a perspective-view of a method 80 of forming protrusions 19 on a wall of the hole $\mathbf{18}_h$ of a drift-tube 18 by tapping the hole $\mathbf{18}_h$ to form internal-threads.

Figure 9:
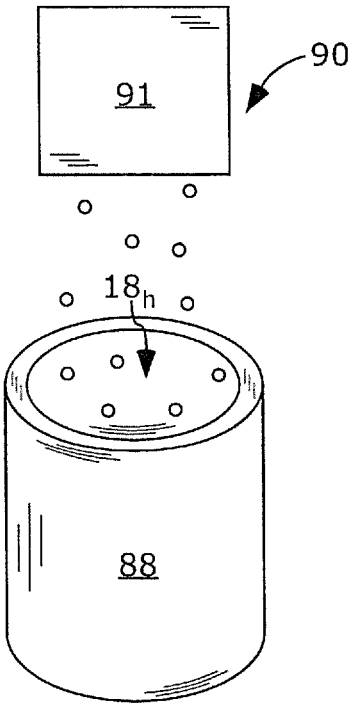

FIG. 9 is a perspective-view of a method 90 of forming protrusions 19 on a wall of the hole $\mathbf{18}_h$ of a drift-tube 18 by abrasive media blasting.

Figure 10:
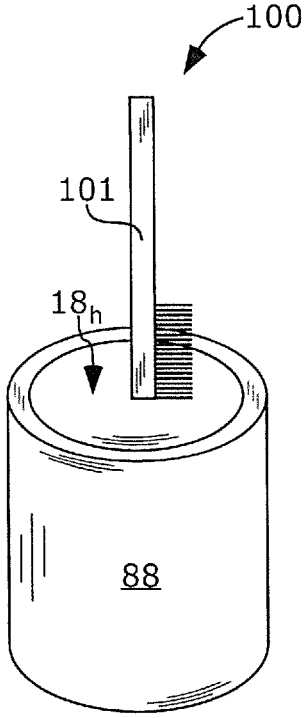

FIG. 10 is a perspective-view of a method 100 including using a wire brush 101 to form protrusions 19 on a wall of the hole $\mathbf{18}_h$ of a drift-tube 18.

Figure 11:
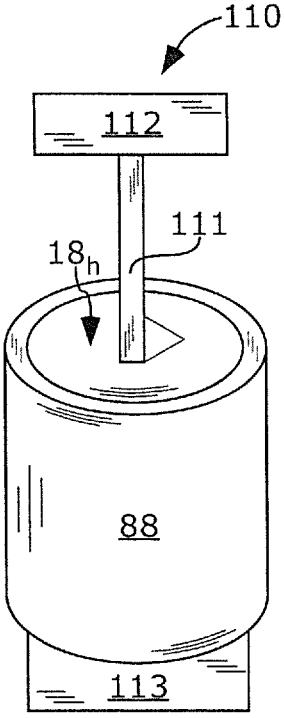

FIG. 11 is a perspective-view of a method 110 including using a lathe 113 and a lathe tool 111 to form protrusions 19 on a wall of the hole $\mathbf{18}_h$ of a drift-tube 18.

Figure 12:
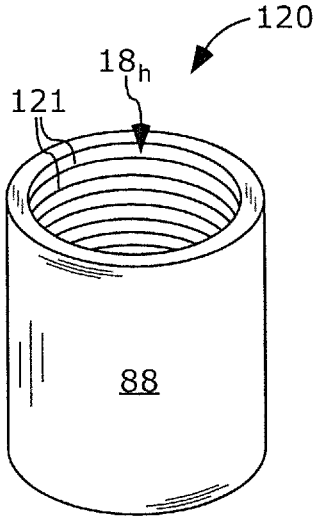

FIG. 12 is a perspective-view of a method 120 of forming protrusions 19 on a wall of the hole $\mathbf{18}_h$ of a drift-tube 18 by inserting a coiled wire 121 inside of the hole $\mathbf{18}_h$.

DEFINITIONS

The following definitions, including plurals of the same, apply throughout this patent application.

As used herein, the term "mm" means millimeter(s).

As used herein, the terms "on", "located on", "located at", and "located over" mean located directly on or located over with some other solid material between.

As used herein, the term "parallel" means exactly parallel, or substantially parallel, such that planes or vectors associated with the devices in parallel would intersect with an angle of ≤15°. Intersection of such planes or vectors can be ≤1°, ≤5°, or ≤10° if explicitly so stated.

As used herein, the term "perpendicular" means exactly perpendicular, or substantially perpendicular, such that the angle referred to is 90°+/−1°, 90°+/−5°, or 90°+/−10°.

As used herein, the terms "x-ray tube" and "drift-tube" are not limited to tubular/cylindrical shaped devices. The term "tube" is used because this is the standard term used for these devices.

DETAILED DESCRIPTION

As discussed above, it would be helpful to avoid electron build-up on an inside of the x-ray tube, such as on sides of an electrically-insulative cylinder. The invention is directed to various x-ray tubes, and methods of making x-ray tubes, that solve this problem.

X-ray tubes 10 and 20, with reduced electron-backscatter, are illustrated in FIGS. 1 & 2. X-ray tubes 10 and 20 can include a cathode 11 and an anode 12 electrically insulated from one another. The cathode 11 and the anode 12 can be electrically insulated from each other by an electrically-insulative cylinder 15. The electrically-insulative cylinder 15 can be made of glass or ceramic. The cylinder 15, cathode 11 and anode 12 can be hermetically sealed and can form an evacuated chamber.

An electron-emitter $\mathbf{11}_{EE}$ at the cathode 11 can emit electrons in an electron-beam along axis 16 to a target 14 of the anode 12. The target can include a high atomic number element, such as gold, rhodium, or tungsten, for generation of x-rays 17 in response to the impinging electrons.

Some electrons can rebound or backscatter. If these back-scattered electrons hit the electrically-insulative cylinder 15, they can accumulate and charge the cylinder 15. This charge can result in arcing failure, shifting the electron-beam, or both. This charge can be avoided or minimized by use of a drift-tube 18, as described herein.

The drift-tube 18 can include protrusions 19 on an interior surface. Electrons that hit these protrusions 19 can rebound to the target 14 or to other protrusions 19. The drift-tube 18 can be metallic or can include a metal. The drift-tube 18 can be attached to, electrically-coupled to, and part of the anode 12. The drift-tube 18 and the anode 12 can be grounded. Electrons hitting the protrusions 19, that don't rebound to the target, can flow to the anode 12 or to ground. The protrusions 19 can have a shape, as described below, for improved electron capture or rebound to the target 14.

The drift-tube 18 can have a hollow, cylindrical shape. A hole $\mathbf{18}_h$, through the drift-tube 18 can be aimed for the electrons from the electron-emitter $\mathbf{11}_{EE}$ to pass through to the target 14. The hole $\mathbf{18}_h$ can include a drift-tube-entry $\mathbf{18}_{en}$, nearer the electron-emitter $\mathbf{11}_{EE}$, and a drift-tube-exit $\mathbf{18}_{ex}$, nearer the target 14. The target 14 can be mounted at the drift-tube-exit $\mathbf{18}_{ex}$.

The drift-tube 18 can be used in a transmission-target x-ray tube 10 (FIG. 1). The target 14 can be mounted on the x-ray window 13. The target 14 can adjoin the x-ray window 13.

The drift-tube 18 can be used in a reflective-target x-ray tube 20 (FIG. 2), or in a side-window x-ray tube 20 (FIG. 2). The target 14 can be spaced apart from the x-ray window 13.

An enlarged drift-tube 18, for a transmission-target x-ray tube 10, is illustrated in FIGS. 3-7. This drift-tube 18 may be adapted for use in a reflective-target x-ray tube 20 (a) by addition of an x-ray hole $\mathbf{18}_x$, (b) by modifying an angle of a face of the drift-tube-exit $\mathbf{18}_{ex}$, or (c) both, as illustrated in FIG. 2.

The drift-tube 18 can include multiple protrusions 19 on an internal wall of the hole $\mathbf{18}_h$. Each protrusion 19 can include a peak $\mathbf{19}_p$, an entry-side $\mathbf{19}_{en}$, and an exit-side $\mathbf{19}_{ex}$. The peak $\mathbf{19}_p$ can be a highest point or region of the protrusion 19 towards the axis 16 of the electron-beam or the drift-tube 18. The entry-side $\mathbf{19}_{en}$ can be a face of the protrusion 19 nearer the drift-tube-entry $\mathbf{18}_{en}$, from the peak $\mathbf{19}_p$ to a base $\mathbf{19}_b$ of the protrusion 19. The exit-side $\mathbf{19}_{ex}$ can be a face of the protrusion 19 nearer the drift-tube-exit $\mathbf{18}_{ex}$, from the peak $\mathbf{19}_p$ to the base $\mathbf{19}_b$ of the protrusion 19.

Each peak $\mathbf{19}_p$ can extend into the hole $\mathbf{18}_h$ towards the axis 16. The protrusion 19 can recede to the base $\mathbf{19}_b$ farther from the axis 16, on both the drift-tube-entry $\mathbf{18}_{en}$, side and on the drift-tube-exit $\mathbf{18}_{ex}$ side. The entry-side $\mathbf{19}_{en}$, the exit-side $\mathbf{19}_{ex}$, or both can slope from the peak $\mathbf{19}_p$, away from the axis 16 of the electron-beam or the drift-tube 18, to the base $\mathbf{19}_b$ of the protrusion 19. This slope, facing or tilting towards the target, can improve electron capturing or rebounding to the target 14 or other protrusions 19.

The radius and thickness relationships of the following paragraphs, and illustrated in FIGS. 3-4, can be used to shape the protrusions 19 and the drift-tube 18 to direct the angle of electron rebound to the target 14.

The radius $R_p$ of the hole $\mathbf{18}_h$ at the peak $\mathbf{19}_p$ can be less than the radius $R_{en}$ and/or $R_{ex}$ of the hole $\mathbf{18}_h$ at the base $\mathbf{19}_b$ ($R_p<R_{en}$, $R_p<R_{ex}$, or both). $R_p$ is a radius of the hole $\mathbf{18}_h$ from the peak $\mathbf{19}_p$ to the axis 16. $R_{en}$ is a radius of the hole $\mathbf{18}_h$ from the base $\mathbf{19}_b$, at an entry-side nearer the drift-tube-entry $\mathbf{18}_{en}$, to the axis 16. $R_{ex}$ is a radius of the hole $\mathbf{18}_h$, from the base $\mathbf{19}_b$ to the axis 16 at an exit-side nearer the drift-tube-exit $\mathbf{18}_{ex}$, to the axis 16.

Protrusion 19 thickness $P_{th}$ can be selected, relative to the radius $R_p$ of the hole $\mathbf{18}_h$, to (a) avoid electrons from the electron-beam hitting the protrusions 19 and reflecting back towards the electron-emitter $\mathbf{11}_{EE}$, but also (b) optimize reflection of electrons from the target 14, back to the target 14. These relationships include: $R_p \geq 2*P_{th}$, $R_p \geq 3*P_{th}$, $R_p \geq 4*P_{th}$, $R_p \leq 6*P_{th}$, $R_p \leq 8*P_{th}$, $R_p \leq 10*P_{th}$, and $R_p \leq 15*P_{th}$. $P_{th}$ is a thickness of the protrusions 19 from the base $\mathbf{19}_b$, at an exit-side $\mathbf{19}_{ex}$ nearer the drift-tube-exit $\mathbf{18}_{ex}$, to the peak $\mathbf{19}_p$.

The protrusions 19 can make the wall non-linear from the drift-tube-entry $\mathbf{18}_{en}$ to the drift-tube-exit $\mathbf{18}_{ex}$. Thus, a line 31 (FIG. 3) from the drift-tube-entry $\mathbf{18}_{en}$ to the drift-tube-exit $\mathbf{18}_{ex}$, along a face $\mathbf{18}_{ff}$ of a footing $\mathbf{18}_f$ of the drift-tube 18, can cross protrusion(s) 19. The face $\mathbf{18}_{ff}$ of the footing $\mathbf{18}_f$ can be even with the base $\mathbf{19}_b$.

Multiple protrusions 19 may be crossed by such line 31, such as ≥2, ≥5, ≥10, or ≥25 protrusions 19. For example, the lines 31 in FIG. 3 cross four protrusions 19.

By encircling the wall with the protrusions 19, any line 31 (FIG. 3) from the drift-tube-entry $\mathbf{18}_{en}$ to the drift-tube-exit $\mathbf{18}_{ex}$, along the face $\mathbf{18}_{ff}$ of a footing $\mathbf{18}_f$ of the drift-tube 18, can cross protrusion(s) 19. Thus, the protrusions 19 interrupt the line 31 and the face $\mathbf{18}_{ff}$ of the footing $\mathbf{18}_f$. Multiple protrusions 19 can increase the likelihood of intercepting scattered electrons.

As illustrated in FIGS. 4-5, the exit-side $\mathbf{19}_{ex}$ can be shaped to reduce electron backscatter, by tilting the exit-side $\mathbf{19}_{ex}$ of the protrusions 19 towards drift-tube-exit $\mathbf{18}_{ex}$. This tilt changes the angle of incidence, and thus also the angle of rebound back towards the target 14. The exit-side $\mathbf{19}_{ex}$ of each protrusion can be perpendicular to an axis 16 of the electron-beam or the drift-tube, as shown in FIG. 4. The exit-side $\mathbf{19}_{ex}$ can be tilted farther, forming a channel 56 between the exit-side $\mathbf{19}_{ex}$ and the face $\mathbf{18}_{ff}$ of the footing $\mathbf{18}_f$ of the drift-tube 18 to which the protrusion 19 is attached, as shown in FIG. 5. An acute angle A can thus be formed in the channel 56 between the exit-side $\mathbf{19}_{ex}$ and the footing $\mathbf{18}_f$. Thus, the exit-side $\mathbf{19}_{ex}$ can face the footing $\mathbf{18}_f$. These shapes can be achieved by modifying a tap, lathe, or other tool that forms the protrusions 19.

As illustrated in FIGS. **3-6*b*, each protrusion 19 can be a rib or internal-thread that can encircle, partially or completely, on the wall of the hole $\mathbf{18}_h$, the axis 16 of the electron-beam or the drift-tube. Note that only half of the drift-tube 18** is shown in these figures, and the other half would complete this encircling.

As illustrated in FIG. 3, the protrusions 19 can be a single helix or multiple nested helices, such as internal-threads, and namely a screw thread. The internal-threads can be connected to each other in a single, continuous internal-thread. Note that only half of the drift-tube 18 is shown in FIG. 3—the other half would complete the single, continuous internal-thread. Thus, the term "multiple protrusions" includes a single, continuous internal-thread, because this continuous internal-thread forms multiple ribs between the drift-tube-entry $\mathbf{18}_{en}$ and the drift-tube-exit $\mathbf{18}_{ex}$. Internal-threads can be manufactured repeatedly and inexpensively, and effective at reflecting electrons back to the target 14.

The protrusions 19 can be separate rings or ribs (FIGS. **4-6*b*). Each ring or rib can circumscribe the wall of the hole $\mathbf{18}_h$ and the axis 16 of the electron-beam or the drift-tube. Multiple rings or ribs can be arranged concentrically and in series between the drift-tube-entry $\mathbf{18}_{en}$ and the drift-tube-exit $\mathbf{18}_{ex}$. The separate ribs might not be as simple to make as internal-threads, but can manufactured repeatedly (e.g. CNC lathe), and can be effective at reflecting electrons back to the target 14**.

In contrast, in FIG. 7, no single bump protrusion 19 encircles the electron beam or the axis 16; but multiple bump protrusions 19 as a group encircle the electron beam or the axis 16. The protrusions 19 can be bumps that are randomly distributed. The bump protrusions 19 can be raised areas of the drift-tube 18 between divots. These bumps can be easy to make, but with increased variability between different drift-tubes 18.

As illustrated in FIGS. 5 and 7, there can be a protrusion-free region 55 adjacent to the drift-tube-entry $\mathbf{18}_{en}$. This helps avoid sharp electrical-field gradients that otherwise would be caused by protrusions 19 near the drift-tube-entry $\mathbf{18}_{en}$.

Brazing material can be used for brazing the target 14 to the drift-tube 18. As illustrated in FIGS. 5 and 7, there can be a protrusion-free region 55 adjacent to the drift-tube-exit $\mathbf{18}_{ex}$. This helps avoid brazing material from filling gaps between the protrusions 19. Without this protrusion-free region 55, these gaps could siphon braze material away from the braze joint, reducing the likelihood of forming a hermetic bond.

A protrusion-free region 55 can be formed at one end by using a counterbore to form a hole at one end, that won't be tapped with internal-threads. A protrusion-free region 55 can be formed at an opposite end by not tapping the hole $\mathbf{18}_h$ all the way through.

The following relationships are example sizes of the protrusion-free region 55: $L_{en} \geq 0.02*L_d$, $L_{en} \leq 0.10*L_d$, $L_{ex} \geq 0.02*L_d$, and $L_{ex} \leq 0.10*L_d$. $L_{en}$ is a protrusion-free length of the drift-tube 18 from the drift-tube-entry $\mathbf{18}_{en}$ towards the drift-tube-exit $\mathbf{18}_{ex}$. $L_{ex}$ is a protrusion-free length of the drift-tube 18 from the drift-tube-exit $\mathbf{18}_{ex}$ towards the drift-tube-entry $\mathbf{18}_{en}$. $L_d$ is a length of the drift-tube 18 from the drift-tube-entry $\mathbf{18}_{en}$ to the drift-tube-exit $\mathbf{18}_{ex}$. All lengths $L_{en}$, $L_d$, and $L_{ex}$ are measured parallel to the electron-beam.

Electron backscatter to the electrically-insulative cylinder 15 can be reduced further with a tapered hole $\mathbf{18}_h$ in the drift-tube 18. As illustrated in FIG. 6*a*, the wall of the hole $\mathbf{18}_h$ can be angled ($R_{en}<R_{ex}$) for improved electron rebound to the target 14 or other protrusions 19. As illustrated in FIGS. 6*a*-6*b*, the hole $\mathbf{18}_h$ can be tapered with a larger diameter $D_{ex}$ at the drift-tube-exit $\mathbf{18}_{ex}$ and a smaller diameter $D_{en}$ at the drift-tube-entry $\mathbf{18}_{en}$ ($D_{ex}>D_{en}$). This taper can form an acute-angle θ between the axis 16 of the electron-beam or the drift-tube and a line 66 extending from the drift-tube-entry $\mathbf{18}_{en}$ to the drift-tube-exit $\mathbf{18}_{ex}$ along the face $\mathbf{18}_{ff}$ of a footing $\mathbf{18}_f$ of the drift-tube 18. Example value ranges for θ include the following: $1.6° \leq \theta \leq 5.6°$. The taper can have this same value of θ around a circumference of the axis 16. This taper changes the angle of incidence for electrons impinging on the protrusions, and thus also the angle of rebound back towards the target 14.

Selection of a relationship between a pitch P of the internal-threads and the diameter $D_{ex}$ at the drift-tube-exit $\mathbf{18}_{ex}$ can help reduce backscattered electrons that hit the electrically-insulative cylinder 15. See FIGS. 4 and 6*a*. For example, $0.02 \leq P/D_{ex}$, $0.05 \leq P/D_{ex}$, or $0.1 \leq P/D_{ex}$. Other examples include $P/D_{ex} \leq 0.2$, $P/D_{ex} \leq 0.25$, or $P/D_{ex} \leq 0.5$. The diameter $D_{ex}$ is measured at a base of the internal-threads.

An example drift-tube 18 has the following dimensions: $L_d$=8.7 mm, $P_{th}$=0.3 mm, $R_p$=1.75 mm, and θ<3.6°.

Method

A method of making a drift-tube 18 with backscatter suppression can comprise some or all of the following steps. The drift-tube 18 and its components can have properties as described above.

As illustrated in FIGS. 8-12, the method can include (a) providing a metallic cylinder 88 with a hole $\mathbf{18}_h$ extending therethrough, and (b) forming protrusions 19 on a wall of the hole.

As illustrated in FIG. 8, the protrusions 19 can be formed by tapping the hole $\mathbf{18}_h$ (e.g. with tap 81) to form internal-threads. The tap 81 can be tapered to form a tapered internal diameter of the hole $\mathbf{18}_h$.

As illustrated in FIG. 9, the protrusions 19 can be formed by roughening the wall of the hole $\mathbf{18}_h$ by abrasive media blasting. An abrasive media blaster tool 91, such as a sand blaster or a bead blaster, is shown in FIG. 9. As illustrated in FIG. 10, the protrusions 19 can be formed by roughening the wall of the hole $\mathbf{18}_h$ with a wire brush 101. The abrasive media blaster tool 91 or the wire brush 101 can form bump protrusions 19 as illustrated in FIG. 7. The bump protrusions 19 can be raised areas of the drift-tube 18 between divots.

As illustrated in FIG. 11, the protrusions 19 can be formed by a lathe 113 and a lathe tool 111. The lathe tool 111 can be controlled by a CNC 112 or by hand. The lathe 113 and the lathe tool 111 can form the separate rings or ribs shown in FIGS. 4-6*b*. The lathe 113 can also cut the hole $\mathbf{18}_h$.

As illustrated in FIG. 11, the protrusions 19 can be formed by placing a coiled wire 121 inside of the hole $\mathbf{18}_h$. The coiled wire 121 can be a spring. The coiled wire 121 can have the same material composition as, or a different material composition than, the drift tube 18. The coiled wire 121 can be welded or fastened into place.

What is claimed is:

1. An x-ray tube comprising:

a cathode and an anode electrically insulated from one another, the cathode including an electron-emitter configured to emit electrons in an electron-beam towards the anode, the anode including a target configured for generation of x-rays in response to impinging electrons from the cathode;

the anode including a drift-tube, a hole through the drift-tube aimed for the electrons from the electron-emitter to pass through to the target;

the hole having a drift-tube-entry nearer the electron-emitter and a drift-tube-exit nearer the target, an internal wall of the hole being non-linear from the drift-tube-entry to the drift-tube-exit and including multiple protrusions;

each protrusion having a peak extending into the hole, and receding to a base farther from an axis of the drift-tube, on an entry-side nearest the drift-tube-entry and on an exit-side nearest the drift-tube-exit; and each protrusion facing the electron-beam with no solid material located between each protrusion and the electron-beam.

2. The x-ray tube of claim 1, wherein the protrusions are internal-threads.

3. The x-ray tube of claim 2, wherein $0.05 \leq P/D_{ex} \leq 0.25$, where P is a pitch of the internal-threads and $D_{ex}$ is a diameter of the drift-tube-exit measured at a base of the internal-threads.

4. The x-ray tube of claim 1, wherein for ail protrusions $2*P_{th} \leq R_p 8*P_{th}$, where $P_{th}$ is a thickness of the protrusion from the base to the peak and $R_p$ is a radius of the hole from the peak to a center of the drift-tube.

5. An x-ray tube comprising:

a cathode and an anode electrically insulated from one another, the cathode including an electron-emitter configured to emit electrons in an electron-beam towards the anode, the anode including a target configured for generation of x-rays in response to impinging electrons from the cathode;

the anode including a drift-tube, a hole through the drift-tube aimed for the electrons from the electron-emitter to pass through to the target;

the hole having a drift-tube-entry nearer the electron-emitter and a drift-tube-exit nearer the target, an internal wall of the hole including multiple protrusions;

each protrusion having a peak, an entry-side nearer the drift-tube-entry, an exit-side nearer the drift-tube-exit, the entry-side and the exit-side sloping from the peak, away from an axis of the drift-tube, to a base of the protrusion; and each protrusion facing the electron-beam with no solid material located between each protrusion and the electron-beam.

6. The x-ray tube of claim 5, wherein:

the wall is non-linear from the drift-tube-entry to the drift-tube-exit;

a line from the drift-tube-entry to the drift-tube-exit, along a face of a footing of the drift-tube, crosses multiple protrusions, the face of the footing being even with the base of the protrusions.

7. The x-ray tube of claim 5, wherein the exit-side is perpendicular to the axis of the drift-tube.

8. The x-ray tube of claim 5, wherein the protrusions are internal-threads.

9. An x-ray tube comprising:

a cathode and an anode electrically insulated from one another, the cathode including an electron-emitter configured to emit electrons in an electron-beam towards the anode, the anode including a target configured for generation of x-rays in response to impinging electrons from the cathode;

the anode including a drift-tube, a hole through the drift-tube and aimed for the electrons from the electron-emitter to pass through the hole to the target, the hole having a drift-tube-entry nearer the electron-emitter and a drift-tube-exit nearer the target;

multiple protrusions on an internal wall of the hole;

$R_p<R_{en}$ and $R_p<R_{ex}$ for each protrusion, where $R_p$ is a radius of the hole from the peak to a center of the drift-tube, $R_{en}$ is a radius of the hole from a base of the protrusion at an entry-side nearer the drift-tube-entry, and $R_{ex}$ is a radius of the hole from the base of the protrusion at an exit-side nearer the drift-tube-exit; and each protrusion facing the electron-beam with no solid material located between each protrusion and the electron-beam.

10. The x-ray tube of claim 9, wherein for all protrusions $2*P_{th}\leq R_p\leq 8*P_{th}$, where $P_{th}$ is a thickness of the protrusion from the base to the peak.

11. The x-ray tube of claim 8, wherein $R_{en}<R_{ex}$.

12. The x-ray tube of claim 9, wherein the exit-side forms an acute angle, outside of the protrusion, with respect to a footing of the drift-tube to which the protrusion is attached.

13. The x-ray tube of claim 9, wherein the exit-side of each protrusion is perpendicular to an axis of the drift-tube, the axis of the drift-tube extending between the electron-emitter and the target at a center of the drift-tube.

14. The x-ray tube of claim 9, wherein $0.02*L_d\leq L_{en}\leq 0.10*L_d$, $0.02*L_d\leq L_{ex}\leq 0.10*L_d$, where $L_{en}$ is a protrusion-free length of the drift-tube from the drift-tube-entry towards the drift-tube-exit, $L_{ex}$ is a protrusion-free length of the drift-tube from the drift-tube-exit towards the drift-tube-entry, and $L_d$ is a length of the drift-tube from the drift-tube-entry to the drift-tube-exit, all lengths measured parallel to the drift-tube.

15. The x-ray tube of claim 9, wherein each protrusion encircles the center of the drift-tube on the wall of the hole.

16. The x-ray tube of claim 9, wherein $D_{ex}>D_{en}$, where $D_{ex}$ is a diameter of the hole at the drift-tube-exit and $D_{en}$ is a diameter of the hole at the drift-tube-entry.

17. The x-ray tube of claim 16, wherein a line, extending from the drift-tube-entry to the drift-tube-exit, along a face of a footing of the drift-tube, forms an acute-angle (θ) with respect to an axis of drift-tube, and $1.6°\leq\theta\leq 5.6°$.

18. The x-ray tube of claim 9, wherein the protrusions are internal-threads.

19. The x-ray tube of claim 18, wherein the internal-threads are connected to each other in a single, continuous internal-thread.

20. The x-ray tube of claim 9, wherein the target is mounted at the drift-tube-exit.

* * * * *